US007832570B1

(12) United States Patent
Reynolds

(10) Patent No.: US 7,832,570 B1
(45) Date of Patent: Nov. 16, 2010

(54) SHELVING CONSTRUCTION

(76) Inventor: Margaret M. Reynolds, 908 Forest Hill Dr., Greensboro, NC (US) 27410

( * ) Notice: Subject to any disclaimer, the term of this patent is extended or adjusted under 35 U.S.C. 154(b) by 330 days.

(21) Appl. No.: 11/982,266

(22) Filed: Nov. 1, 2007

(51) Int. Cl.
*A47H 1/00* (2006.01)

(52) U.S. Cl. ..... 211/103; 211/187; 211/207

(58) Field of Classification Search ..... 211/103, 211/187, 190, 207, 186, 135, 134, 189
See application file for complete search history.

(56) References Cited

U.S. PATENT DOCUMENTS

| | | | | | |
|---|---|---|---|---|---|
| 1,599,653 | A * | 9/1926 | Cranston | 108/185 |
| 3,250,584 | A * | 5/1966 | Tassell | 312/247 |
| 3,664,627 | A * | 5/1972 | Sykes | 248/246 |
| 3,752,088 | A * | 8/1973 | Kapnek | 108/152 |
| 4,585,131 | A * | 4/1986 | Crossman et al. | 211/206 |
| 4,712,286 | A * | 12/1987 | Wolf | 29/463 |
| 5,318,264 | A * | 6/1994 | Meiste | 248/222.12 |
| 5,799,588 | A | 9/1998 | Engel | 108/108 |
| 6,164,610 | A * | 12/2000 | Santiago | 248/235 |
| 6,591,996 | B1 * | 7/2003 | Wu | 211/90.02 |
| 6,615,745 | B2 * | 9/2003 | Cinkaj | 108/152 |
| 7,165,690 | B2 * | 1/2007 | Wu | 211/192 |
| 2001/0002521 | A1 * | 6/2001 | Maniezzo | 52/27 |
| 2008/0210651 | A1 * | 9/2008 | Chen | 211/207 |

OTHER PUBLICATIONS

Sixteen (16) page printout from the website www.rakks.com entitled "The Specification Guide" relating to shelving, Copyright date 2005-2007 Rangine Corporation.

* cited by examiner

*Primary Examiner*—Janet M Wilkens
*Assistant Examiner*—Dan Rohrhoff

(57) ABSTRACT

Shelving construction for customizing shelves used on interior walls of homes, offices or other buildings is described. Longitudinal members are first attached to a vertical interior wall for receiving shelf arms which are adjustably attached therealong. The longitudinal members are covered with a wood veneer and the shelf arms are then inserted into box-like wooden shelves which provide an all-wood appearance. The shelving construction can be easily modified by adding to the existing configuration. Each longitudinal member includes a series of grooves for receiving threaded plates which rotate for releasable engagement with the arms.

11 Claims, 9 Drawing Sheets

SHELVING CONSTRUCTION

FIELD OF THE INVENTION

The invention herein pertains to wall shelving and particularly pertains to shelving which can have a variety of configurations depending on the wants and needs of the particular user with full vertical adjustability.

DESCRIPTION OF THE PRIOR ART AND OBJECTIVES OF THE INVENTION

Shelving has consisted of many designs in past years both for freestanding and wall attached types. Shelving which is affixed to interior building walls is well known and the shelves are usually adjusted by vertically moving the shelf arms incrementally. However, mounting, affixing and adjusting shelves is often difficult to achieve by unskilled people. U.S. Pat. No. 5,799,588 of Engel shows an example of a modern wall mounted shelf system with adjustable shelves.

Various problems exist with known adjustable shelving in that the shelves can be difficult to adjust and maintain. Also, certain adjustable shelving is complicated, expensive and is not suitable for a wide variety of applications. Other adjustable shelving does not provide for customizing with ease and convenience without skill and expensive tools. Therefore, it is one objective of the present invention to provide shelving construction which can be installed and assembled by those of relatively little manual skills.

It is another objective of the present invention to provide shelving construction which can be fitted to a particular room or wall size.

It is yet another objective of the present invention to provide shelving construction which can be customized to the particular owners current needs.

It is still another objective of the present invention to provide shelving construction which can be expanded or contracted as needs change.

It is a further objective of the present invention to provide shelving construction which provides the appearance of natural wood while using parts formed from aluminum and other metals.

It is a still a further objective of the present invention to provide shelving construction which can be purchased at a relatively low cost and installed or removed using simple hand tools.

Various other objectives and advantages of the present invention will become apparent to those skilled in the art as a more detailed description is set forth below.

SUMMARY OF THE INVENTION

The aforesaid and other objectives are realized by providing shelving components which can be purchased at the retail level and easily are assembled by homeowners and others. Longitudinal members consist of aluminum extrusions which are formed with a smooth, planar rear surface for attachment against a vertical wall with conventional fasteners such as screws, nails, adhesives or the like. Depending on the exact use, the longitudinal members are spaced on approximately sixteen inch (16") (0.4 m) centers. The longitudinal members can be purchased in a variety of incremental lengths. Once the longitudinal members are installed shelf arms are inserted into each of the side grooves of the longitudinal member for adjustably affixing to a desired height. Each shelf arm is formed from aluminum and includes a shoulder which is slideable within the side grooves of the longitudinal members. The shelf arms are tightened in place with a threaded member and a wooden veneer is applied to the front of the extruded longitudinal member and is frictionally affixed. Finally, hollow shelves formed from wood are positioned over the arms and are placed against the veneer on the longitudinal members. The completed shelving construction appears as formed from wood and can be thereafter disassembled and moved as needed.

DETAILED DESCRIPTION OF THE PREFERRED EMBODIMENT AND OPERATION OF THE INVENTION

Figure 1:
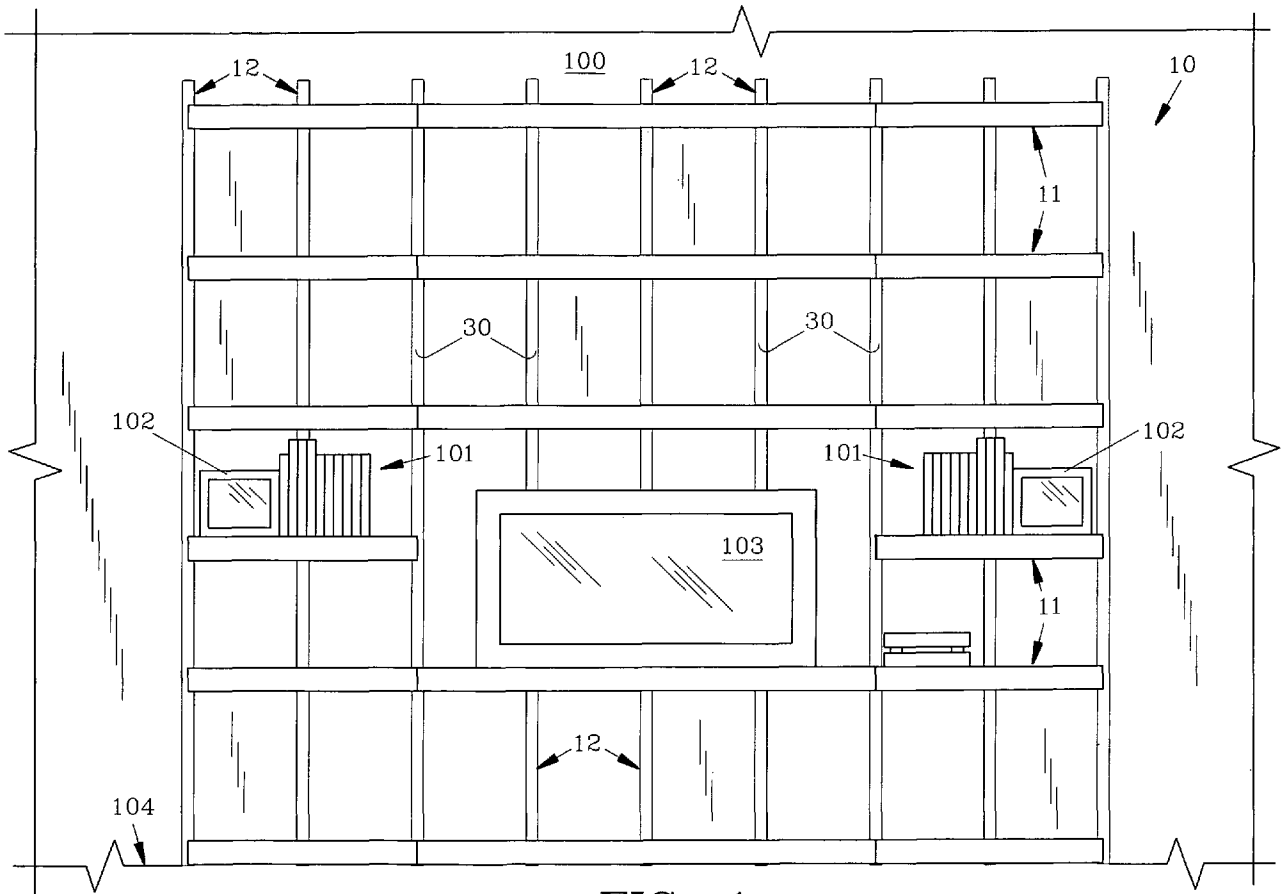
FIG. 1 shows the preferred shelving construction of the invention with each horizontal shelf having full vertical adjustability.

For a better understanding of the invention and its operation, turning now to the drawings, FIG. 1 illustrates preferred shelf construction 10 positioned on inside building wall 100 as in a house, office or other structure. Shelf construction 10 consists of a plurality of horizontal shelves 11 which are adjustably mounted to a plurality of longitudinal members 12 covered with veneer 30. Horizontal shelves 11 vary in length and are selected for the particular uses, sizes and desires of the owner.

Figure 2:
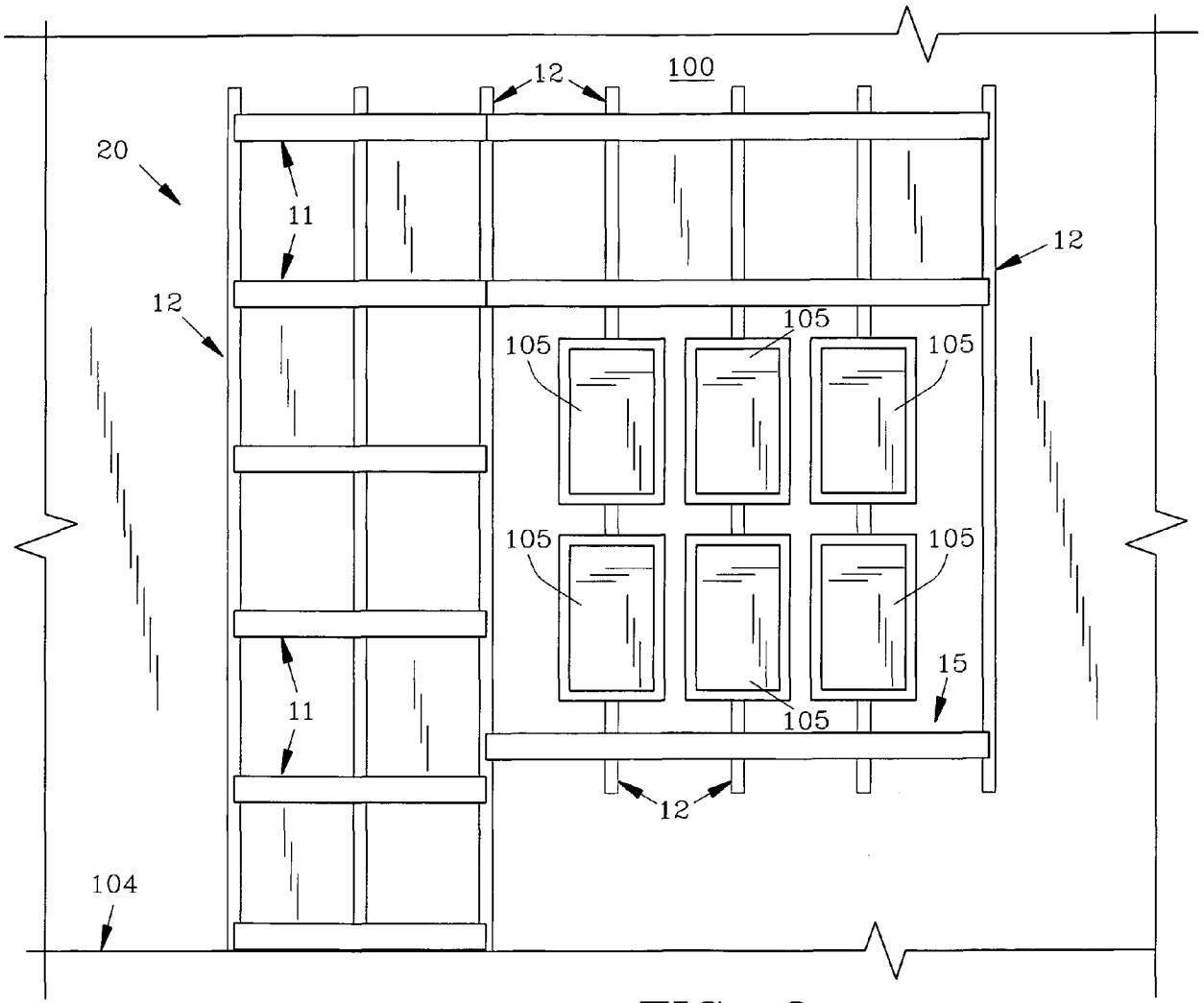
FIG. 2 depicts another shelving construction design.

Shelf construction 10 is useful for supporting standard items such as books 101, pictures 102 or plasma TV 103. As shown, shelf construction 10 extends to floor 104 but could also be mounted as shelf construction 20 shown in FIG. 2. Shelf construction 20, like shelf construction 10 is wall mounted and has been configured to provide a shorter lower shelf 15 which will act as a writing surface or desktop below framed pictures 105 attached to longitudinal member 12.

Longitudinal members 12 are preferably sold in 2' (0.61 m) and 4' (1.22 m) lengths for easy installation though other lengths may also be made and sold. Shelves 11 will be preferably sold in lengths of 16" (4.06 cm) and multiples thereof for convenience purposes.

Figure 12:
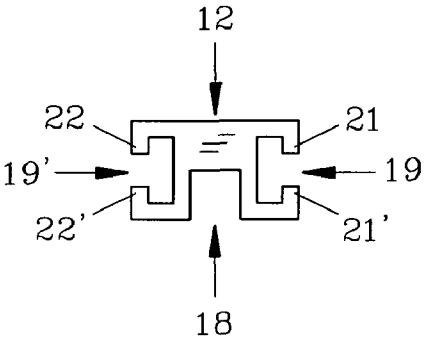
FIG. 12 demonstrates a top plan view of the longitudinal member as seen in FIG. 7.
Figure 13:
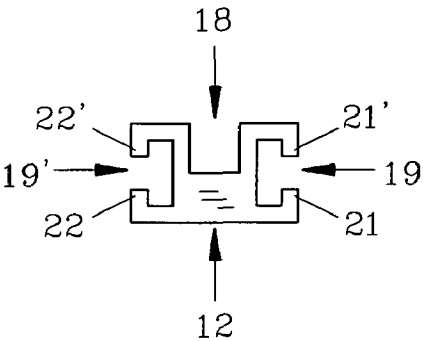
FIG. 13 illustrates a bottom plan view of the longitudinal member as seen in FIG. 7.
Figure 4:
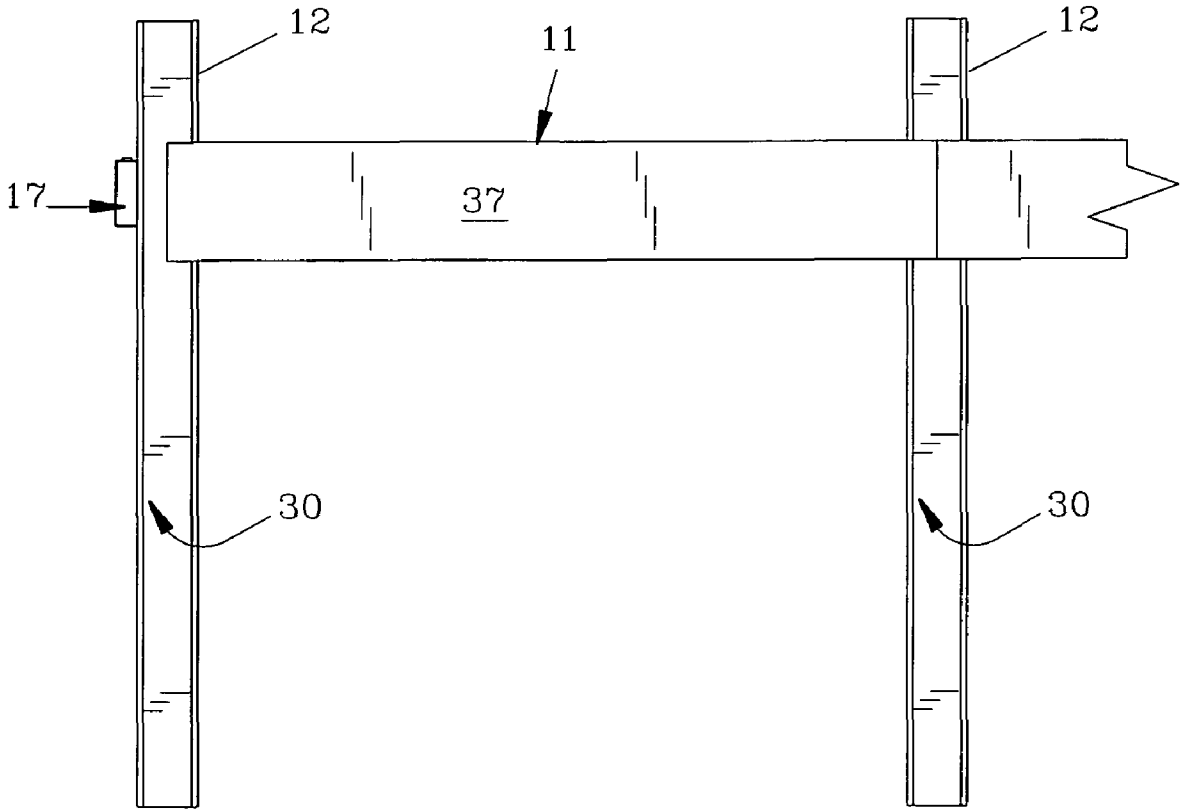
FIG. 4 shows an enlarged partial front elevational view of one fragmented shelf of the shelf construction as seen in FIG. 1.
Figure 9:
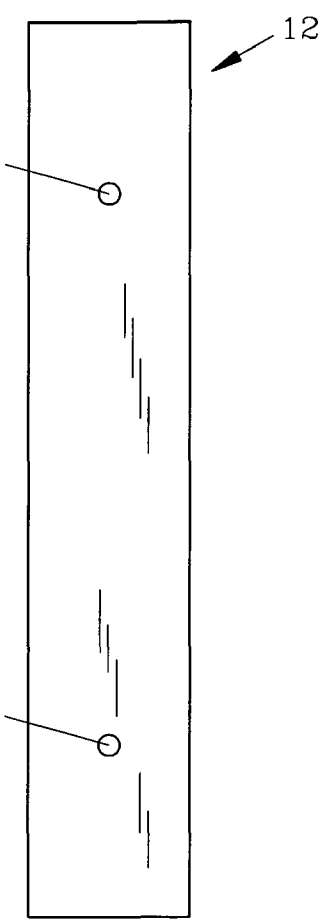
FIG. 9 depicts a rear elevational view of the longitudinal member as seen in FIG. 7.
Figure 8:
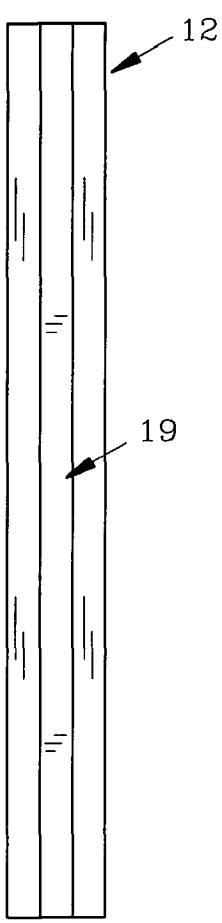
FIG. 8 illustrates a right side elevational view of the longitudinal member as seen in FIG. 7.
Figure 17:
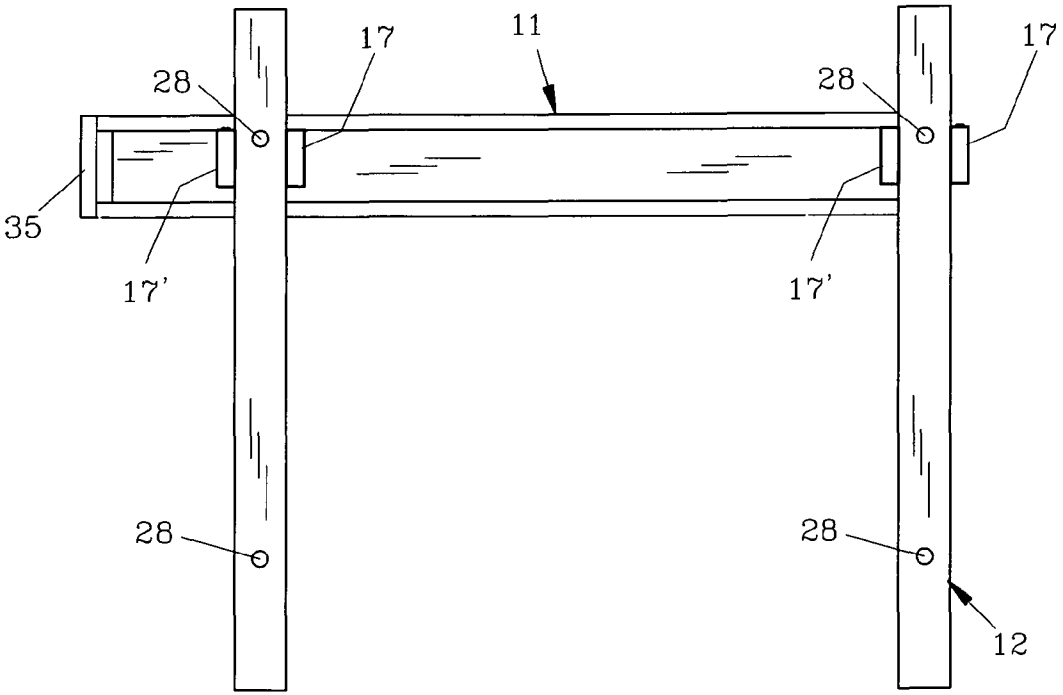
FIG. 17 depicts an enlarged fragmented partial rear elevational view of the shelving construction as seen in FIG. 6.

As shown in FIGS. 7-13, longitudinal member 12 is an aluminum extrusion which includes a front groove 18 and side grooves 19, 19' as seen in FIGS. 12 and 13. Side grooves 19, 19' include flanges 21, 21' and 22, 22' respectively. The rear of longitudinal member 12 is smooth and planar and includes apertures 28 for wall application as seen in FIG. 9. During conventional manufacturing longitudinal member 12 can be extruded in varying lengths as desired. Apertures 28 positioned therealong accept fasteners (not shown) such as nails or screws for attachment to a wall or other vertical surface. Adhesives may also be used under certain circumstances as another means to attach longitudinal member 12 to a vertical surface.

Figure 3:
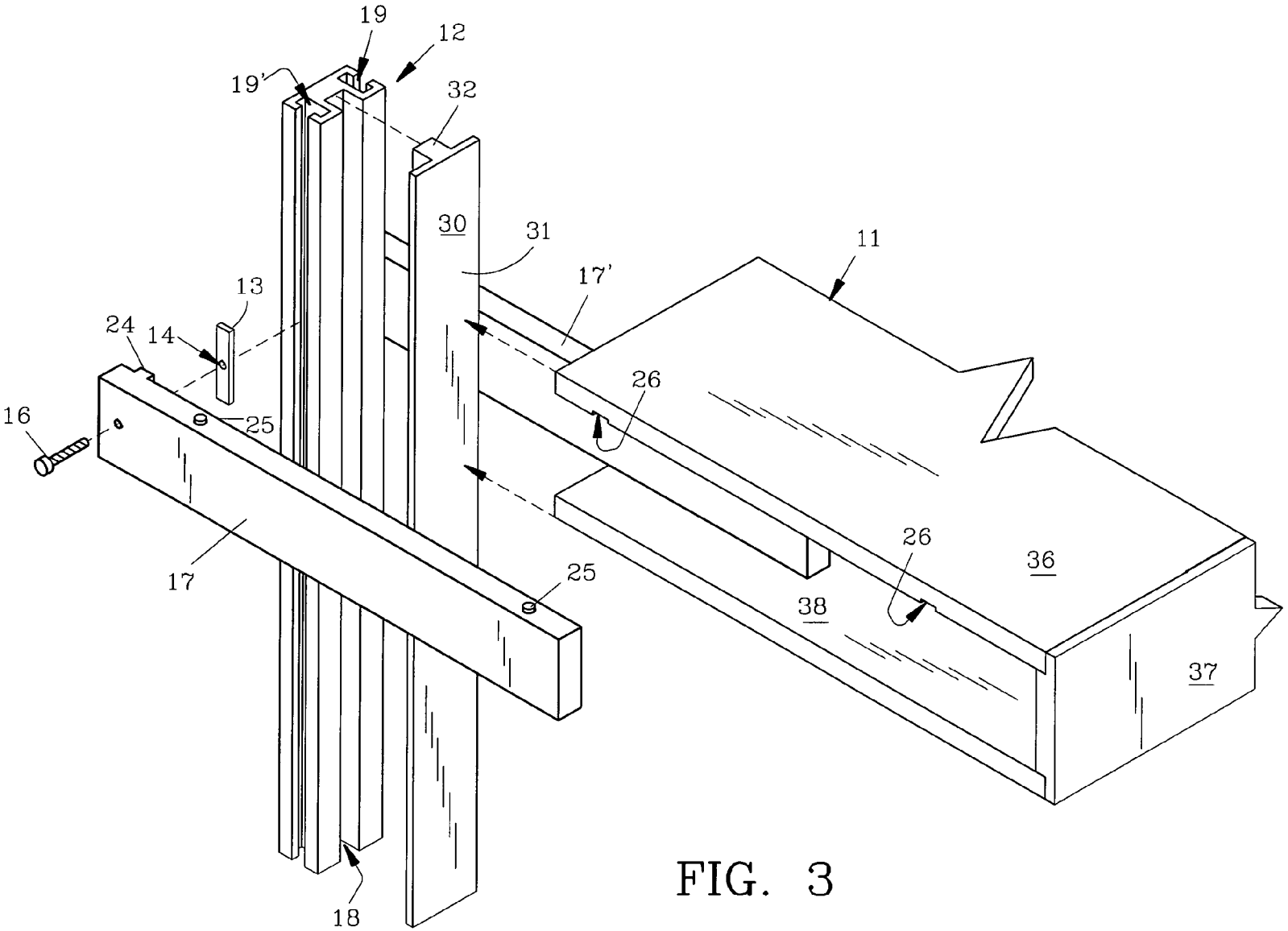
FIG. 3 illustrates an exploded partial schematic of the shelving construction.
Figure 3B:
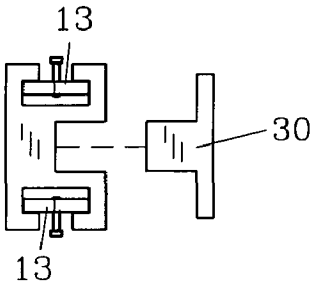
FIG. 3B pictures an enlarged view of the longitudinal member and groove plate in a top view.
Figure 3A:
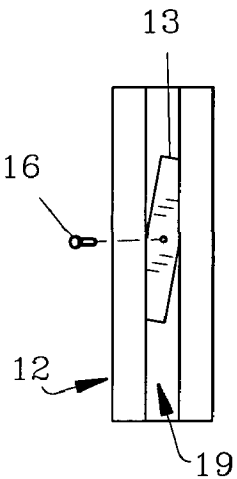
FIG. 3A features an enlarged view of a section of the longitudinal member and groove plate.
Figure 14:
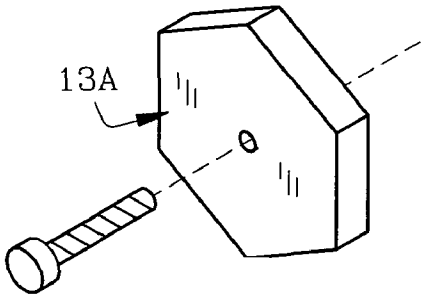
FIG. 14 pictures an alternate groove plate in hexagonal shape.
Figure 15:
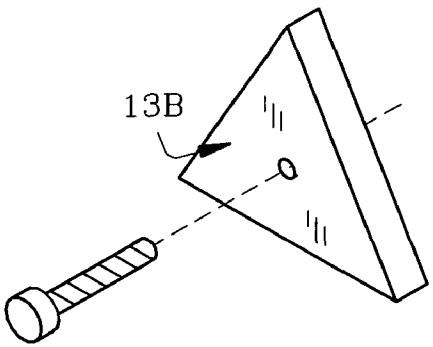
FIG. 15 features another alternate groove plate in triangular shape.

In exploded partial schematic FIG. 3, longitudinal member 12 is illustrated in detached fashion with rectangular groove plate 13 thereabove. Groove plate 13 is formed from aluminum steel or other suitable materials and includes threaded opening 14 for receiving threaded member 16 which first passes through shelf arm 17. Groove plate 13 fits within side grooves 19, 19' and is sized to slightly rotate therein as shown in exploded FIGS. 3A and 3B when tightened by rotation of threaded member 16. This rotation causes tight frictional engagement of groove plate 13 within groove 19' preventing shelf arm 17 from inadvertently slipping or moving once secured. Groove plate 13 in FIG. 3 is shown as having a rectangular shape but could be also formed having an octagonal shape as seen by groove plate 13A shown in FIG. 14 or a triangular shape such as groove plate 13B as shown in FIG. 15.

Shelf arms 17, 17' are also formed from aluminum and include shoulder 24 sized to fit between flanges 22, 22' at groove 19' and flanges 21, 21' at groove 19 respectively. Arms 17, 17' are fitted with resilient polymeric tabs 25 in openings therealong used as "locators" when assembling shelf construction 10. Polymeric tabs 25 help an installer locate notches 26 (FIG. 3) as shelf 11 is slid onto arms 17, 17' during assembly. FIGS. 4-6, 16 and 17 also show various views of shelf 11 affixed to longitudinal member 12. Depending on the particular shelf construction and positioning of shelf 11, one or both of shelf arms 17, 17' may or may not be necessary as seen for example in FIGS. 1 and 2.

Figure 5:
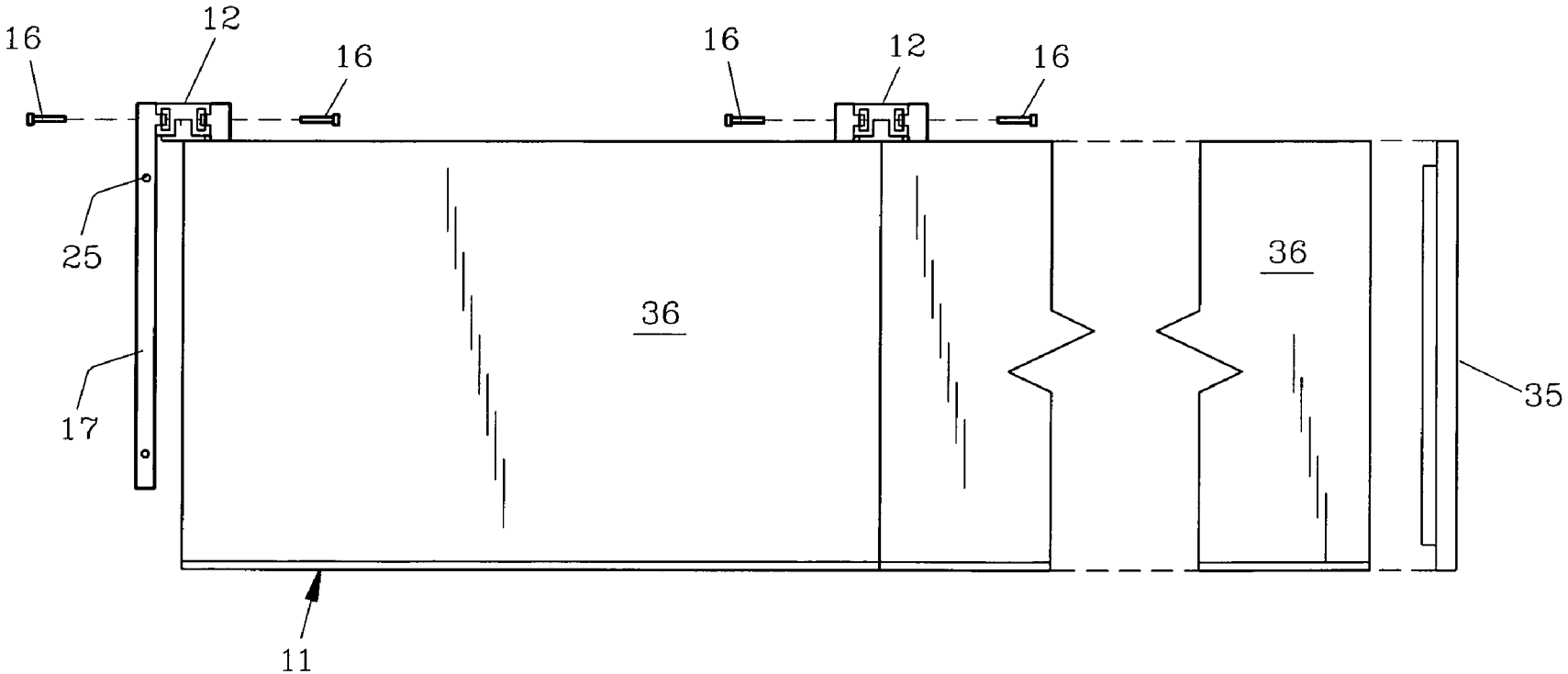
FIG. 5 depicts a top plan view of the shelf construction as seen in FIG. 4.
Figure 16:
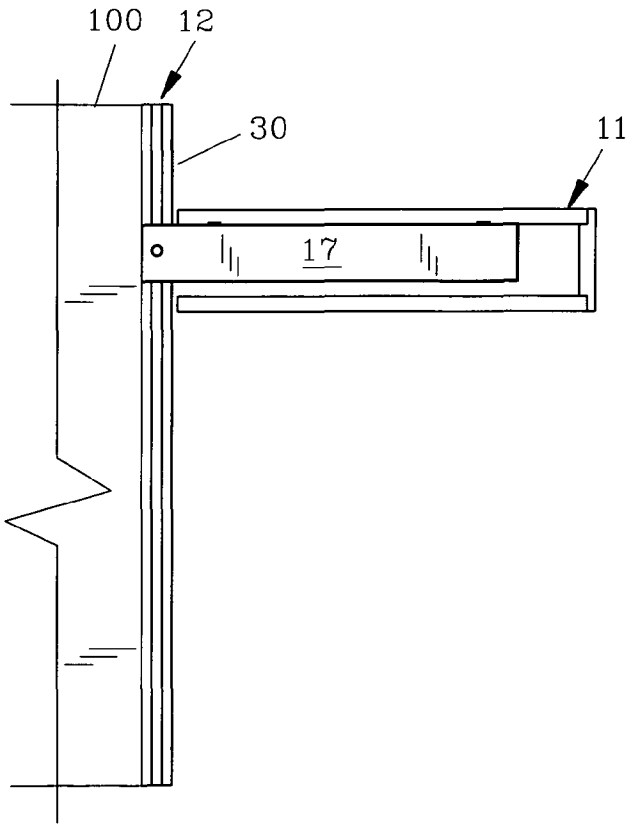
FIG. 16 shows an enlarged fragmented partial side elevational view of the shelving construction as seen in FIG. 6.

Veneer 30 as seen in FIGS. 3, 5 and 16 is formed from painted or finished wood and includes a planar front surface 31 and a rear projection 32. Projection 32 extends the entire length of veneer 30 and tightly engages front groove 18 of longitudinal member 12. Veneer 30, like longitudinal member 12 may be precut to any desired length to compliment longitudinal member 12 for configuring a shelf construction such as shelf constructions 10 or 20 seen respectively in FIGS. 1 and 2.

Figure 6:
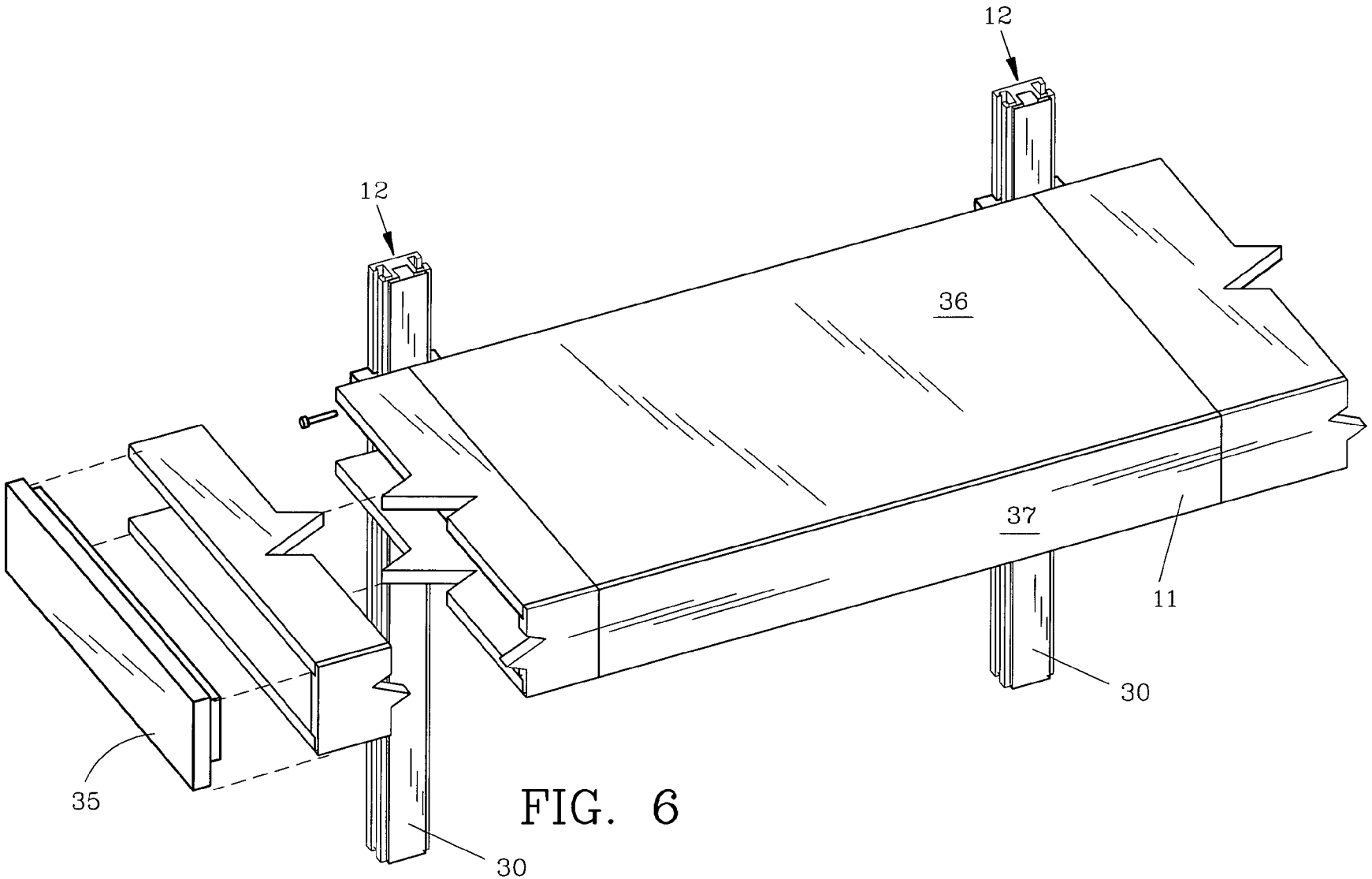
FIG. 6 illustrates a perspective view of the shelf construction as seen in FIG. 5.
Figure 7:
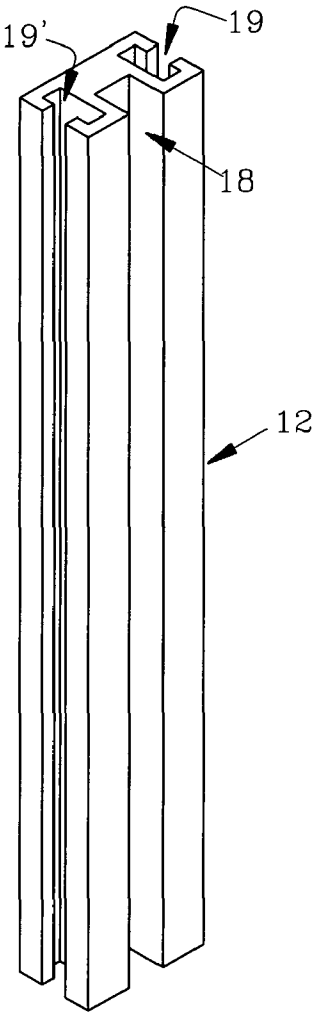
FIG. 7 demonstrates a front, top, perspective view of the longitudinal member of commercial length.
Figure 11:
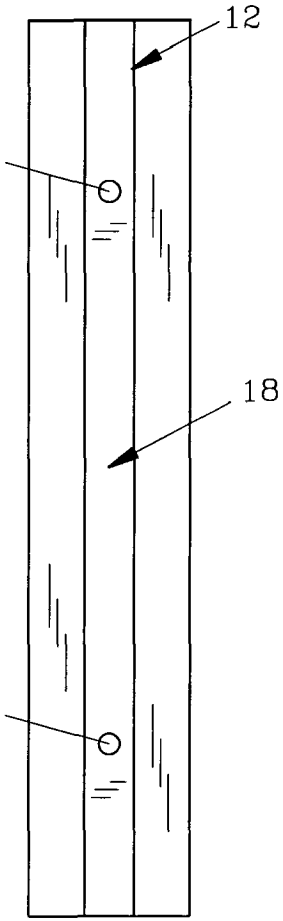
FIG. 11 pictures a front elevational view of the longitudinal member as seen in FIG. 7.
Figure 10:
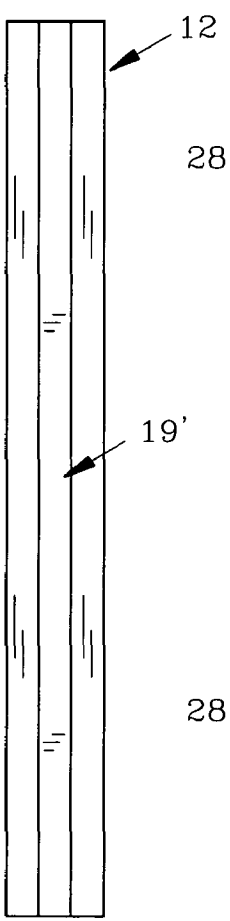
FIG. 10 features a left side elevational view of the longitudinal member as seen in FIG. 7.

As seen in FIGS. 3-6, 16 and 17, preferred wooden shelf 11 is formed from an assembly of top 36, front face 37, bottom 38 and a pair of ends 35 to form a rectangular box structure which slides over arms 17, 17' to abut veneer 30 on longitudinal member 12. In FIGS. 5 and 6, shelf 11 is shown with end 35 removed. Shelf ends 35 are optional but may assist in providing stability to the structure of shelf 11 as well as provide a finished appearance to shelf 11 for aesthetic purposes. Shelf 11 may be formed from other materials such as plastic, glass or combinations thereof.

The method of assembly of shelf construction 10 consists of attaching longitudinal members 12 on a vertical surface such as an interior wall of a building by screws, adhesives or other fasteners (not seen). Next, groove plate 13 is threadably connected to arm 17 by threaded member 16 and is positioned in for example side groove 19' as seen in FIG. 3. Arm 17 with groove plate 13 is now positioned at the approximate desired shelf height with shoulder 24 engaged in side groove 19'. Upon positioning threaded member 16 is tightened causing groove plate 13 to rotate within groove 19' (see FIGS. 3A and 3B) and is trapped behind flanges 22, 22' (FIG. 12) whereby groove plate 13 is frictionally engaged within groove 19'. Arm 17' would likewise be attached to longitudinal member 12. With both arms 17, 17' thus affixed to longitudinal member 12, veneer 30 is then positioned onto the front of longitudinal member 12 by inserting projection 32 into front groove 18. After, arms 17, 17' are completely threadably tightened in the exact desired location (height), thereafter, shelf 11 is positioned on arms 17, 17' with tabs 25 located in shelf notches 26. This process is repeated for each longitudinal member 12 and shelf 11 until the desired shelf construction is achieved. To remove or dismantle shelf construction 10 the process is reversed with shelves 11 being first removed thereafter arms 17, 17' removed by loosening threaded members 16. Thereafter, veneer 30 is disengaged from longitudinal member 12 and finally, longitudinal member 12 is removed from its mounting on the vertical surface or wall.

The illustrations and examples provided herein are for explanatory purposes and are not intended to limit the scope of the appended claims.

I claim:

1. Shelf construction comprising: a longitudinal member, said longitudinal member for mounting to a vertical surface, said longitudinal member defining a front groove and a pair of side grooves, each of said pair of side grooves defined with opposing flanges, a pair of groove plates, said pair of groove plates each contained within different ones of said pair of side grooves, each of said pair of groove plates defining a threaded bore, a pair of arms, said pair of arms each defining a fixed rectangular shoulder, said shoulders each positioned within different ones of said pair of side grooves, a shelf, said shelf comprising a box, said box comprising a top and a bottom, said top opposing said bottom forming a cavity therebetween, said pair of arms positioned within said cavity for supporting said shelf.

2. The shelf construction of claim 1 further comprising veneer, said veneer positioned on said longitudinal member.

3. The shelf construction of claim 2 wherein said veneer defines a shoulder, said veneer shoulder positioned within said front groove.

4. The shelf construction of claim 2 wherein said veneer is formed from wood.

5. The shelf construction of claim 1 further comprising a pair of tabs, said pair of tabs each mounted on different ones of said pair of arms, said top defining a pair of notches, said pair of tabs each positioned within different ones of said pair of notches.

6. The shelf construction of claim 1 wherein each of said pair of arms defines an aperture, a pair of threaded members, each of said pair of threaded members positioned within different ones of said arm apertures.

7. The shelf construction of claim 6 wherein each of said pair of threaded members is tightened within different ones of said threaded bores.

8. The shelf construction of claim 1 wherein each of said pair of groove plates are rectangular.

9. A method of constructing shelves on a wall comprising the steps of:

a) providing a longitudinal member for mounting to a surface having a front groove and a pair of side grooves with opposing flanges, a pair of groove plates each having a threaded bore and each contained within different ones of said pair of side grooves, a pair of arms each defining a fixed shoulder integrally formed therewith, each of said shoulders positioned within different ones of said pair of side grooves, a tab mounted on each of said pair of arms, a shelf comprising a box with a top and a bottom and a cavity therebetween, said top defining a pair of notches each for receiving different ones of the arm tabs;

b) selecting a wall;

c) mounting the longitudinal member vertically thereto;

d) attaching the pair of arms to the longitudinal member; and e) affixing the shelf to the pair of arms with the arm tabs positioned in the top notches inside the box.

10. The method of claim 9 further comprising the step of tightening a threaded member into each one of the pair of groove plates to secure the pair of arms thereto.

11. The method of claim 9 further comprising the step of mounting a veneer to the longitudinal member.

* * * * *